US006518491B2

(12) United States Patent
Kurakake et al.

(10) Patent No.: US 6,518,491 B2
(45) Date of Patent: Feb. 11, 2003

(54) APPARATUS AND METHOD FOR AUTOMATICALLY GENERATING MUSICAL COMPOSITION DATA FOR USE ON PORTABLE TERMINAL

(75) Inventors: Yasushi Kurakake, Hamamatsu (JP); Toshiyuki Ito, Hamamatsu (JP); Masahiro Koyama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/928,190

(22) Filed: Aug. 9, 2001

(65) Prior Publication Data

US 2002/0023529 A1 Feb. 28, 2002

(30) Foreign Application Priority Data

Aug. 25, 2000 (JP) ..... 2000-255666

(51) Int. Cl.[7] ..... G10H 1/36
(52) U.S. Cl. ..... 84/610; 84/650
(58) Field of Search ..... 84/609–614, 634–638, 84/453, 470 R, 477 R, 645, 649–652, 666–669; 434/307 A

(56) References Cited

U.S. PATENT DOCUMENTS 4,790,230 A * 12/1988 Sanderson ..... 84/453 X
5,654,516 A * 8/1997 Tashiro et al. ..... 84/645 X
6,046,396 A * 4/2000 Miyamoto ..... 84/613
6,084,168 A * 7/2000 Sitrick ..... 84/477 R
6,198,904 B1 * 3/2001 Rosen ..... 434/307 A
6,245,984 B1 6/2001 Aoki et al.
6,324,378 B1 * 11/2001 Schlossberg ..... 84/470 R X

* cited by examiner

*Primary Examiner*—Stanley J. Witkowski
(74) *Attorney, Agent, or Firm*—Morrison & Foerster LLP

(57) ABSTRACT

There is input type information defining a type of portable terminal as well as various music composing parameters. Automatic music composition process is carried out on the basis of the input type information and music composing parameters, so as to generate musical composition data suitable for reproduction on a portable terminal of the type indicated by the type information. Balance in predetermined musical characteristics of the generated musical composition data can also be achieved by adjusting the predetermined musical characteristics in accordance with the type of portable terminal. It is also possible to convert the generated musical composition data into a predetermined data format suiting the type of a portable terminal to be used. The generated musical composition data may be transmitted online to the portable terminal.

22 Claims, 5 Drawing Sheets

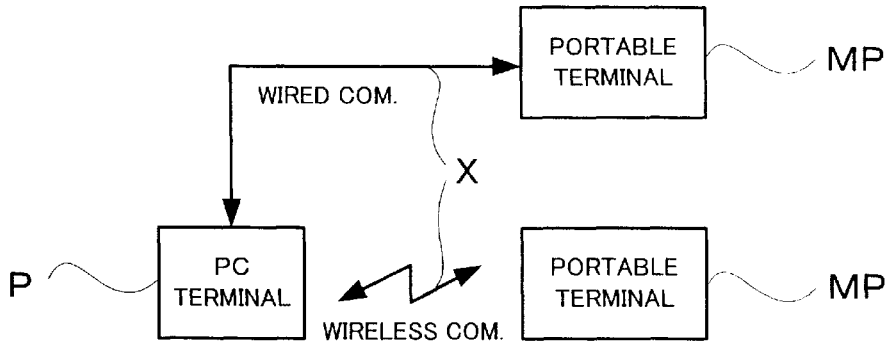
FIG. 1
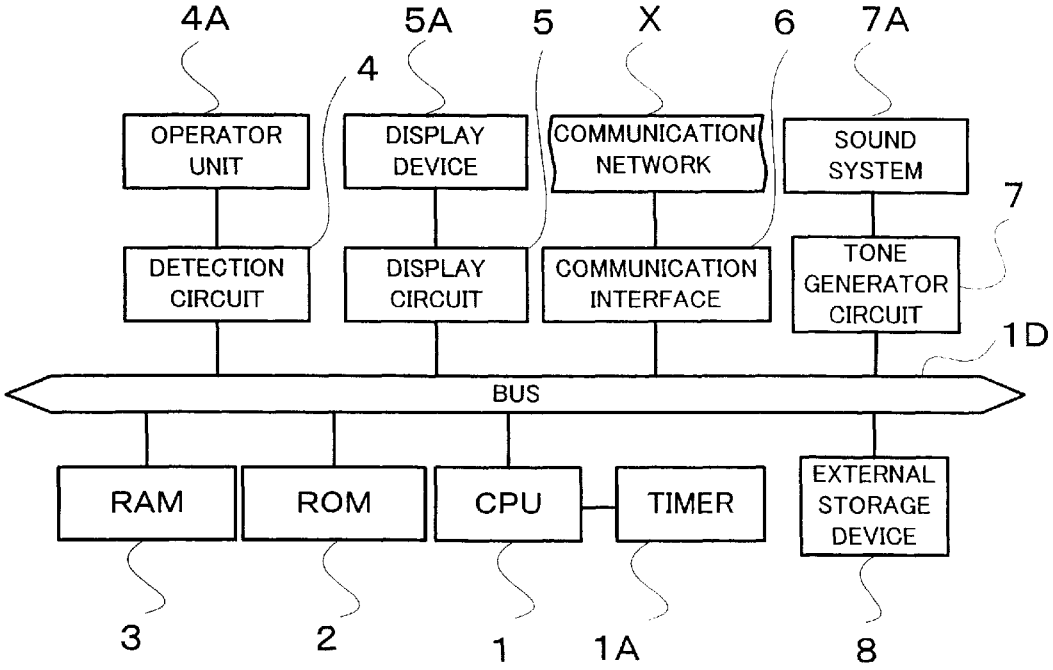
FIG. 2
| | |
|---|---|
| MANUFACTURER A/ MODEL a | 1. 5 |
| MANUFACTURER A/ MODEL b | 0. 5 |
| MANUFACTURER B/ MODEL a | 1. 0 |
| ⋮ | ⋮ |
FIG. 11

APPARATUS AND METHOD FOR AUTOMATICALLY GENERATING MUSICAL COMPOSITION DATA FOR USE ON PORTABLE TERMINAL

BACKGROUND OF THE INVENTION

The present invention relates generally to musical composition data generation apparatus, musical composition data generation methods and storage media for automatically generating musical composition data of melodies and accompaniments. Particularly, the present invention relates to an improved apparatus and method for automatically generating musical composition data suitable for reproduction on a variety of portable terminals, especially cellular phones, of various different types (manufacturers and/or models), in such a manner that a melody or accompaniment can be performed on each of the portable terminals on the basis of the thus automatically-generated musical composition data, as well as a storage medium for use in implementing the automatic musical composition data generation.

The recent proliferation or widespread use of personal computers has allowed every interested person to freely enjoy music by using computer music techniques, for example, to play a musical instrument, compose and arrange a music piece and synthesize a tone color. Particularly, in the field of musical composition using a computer, there have emerged automatic music composition apparatus which allow even a beginner with poor musical expertise to enjoy composing an original melody and accompaniment in a simple manner. Known examples of the automatic music composition apparatus, which automatically create a melody and accompaniment, include a musical composition data generation apparatus which is designed to automatically create or generate musical composition data of a melody and accompaniment on the basis of various input musical parameters characterizing the melody (hereinafter referred as "tone generating parameters"), such as those pertaining to a musical key, musical time, pitch leap dynamics, presence/absence of syncopation and chord progression. In cases where such a musical composition data generation apparatus is employed, a user can compose various original melodies and accompaniments freely and simply by just selectively inputting tone generating parameters to the apparatus.

Also, in recent years, there have been widely used small-sized and lightweight portable terminals, such as cellular phones and PDAs (Personal Digital Assistants), capable of wired or wireless communication, and a great many people are possessing and making use of such portable terminals because of their conveniences. These currently-used portable terminals (especially, cellular phones), irrespective of their manufacturers or models, emit very similar incoming call (message) alerting sounds. Thus, when any one of a plurality of cellular phones in a given place is emitting an incoming call (message) alerting sound, each of the users of the cellular phones can not readily ascertain whether or not his or her cellular phone is receiving an incoming call. To address such an inconvenience, there has recently been supplied a more sophisticated cellular phone equipped with an incoming call alerting melody function which performs, as the incoming call alerting sound, a user-desired melody and accompaniment instead of a monotonous and stereotyped sound. Musical composition data of a melody and accompaniment used in such a cellular phone are registered (stored) in the phone, for example, by the user personally entering the musical composition data through manipulation of keys on the phone or downloading musical composition data of an existing melody and accompaniment, so that the thus-registered musical composition data can be audibly reproduced as the incoming call alerting sound of the phone.

Generally, the musical composition data of a melody and accompaniment used as the incoming call alerting sound in each of the cellular phones have a data format specific to the manufacturer and/or model of the phone. However, the above-discussed conventional musical composition data generation apparatus is only capable of generating musical composition data of an ordinary or common data format, so that the data format of musical composition data generated by the data generation apparatus may not agree with acceptable data formats of some cellular phones depending on the manufacturers and/or models of the cellular phones; that is, some cellular phones may be unable to reproduce the melody and accompaniment based on the musical composition data generated by the data generation apparatus. For a solution to the inconvenience, each of the users of the cellular phones has to personally enter a desired original melody and accompaniment by manipulating the keys on the phone, which would, however, require very troublesome manual entry operations; thus, unless the user is sufficiently experienced in the manual entry operations, it would be difficult for the user to enter a melody and accompaniment as desired. Namely, the conventional musical composition data generation apparatus is quite inconvenient in that it can not readily generate musical composition data suitable for use on a variety of cellular phones of various different manufacturers and/or models. Further, even where the data format of musical composition data generated by the generation apparatus suits cellular phones of a plurality of manufacturers and/or models, the melody and accompaniment would sometimes be reproduced with musical characteristics (e.g., tone volume and quality) differing among the manufacturers and/or models.

In addition, because the data format of musical composition data generated by the generation apparatus can not be converted into another data format fitting cellular phones of a particular manufacturer and/or model, the musical composition data generated by the generation apparatus can not be used on cellular phones of a plurality of different manufacturers and/or models.

SUMMARY OF THE INVENTION

It is therefore an object of the present invention to provide a musical composition data generation apparatus and musical composition data generation method which can automatically generate musical composition data suitable for use on portable terminals, such as cellular phones, of various manufacturers and/or models in such a manner that any one of the portable terminals of various manufacturers and/or models can appropriately reproduce a melody and accompaniment without inconvenience, as well as a storage medium storing machine-executable instructions for implementing such musical composition data generation.

It is another object of the present invention to provide a musical composition data generation apparatus and musical comosotion data generation method which can automatically generate music composition data and convert the thus-generated musical composition data into a data format suitable for use on portable terminals, such as cellular phones, of various manufacturers and/or models in such a manner that any one of the portable terminals of various manufacturers and/or models can reproduce the same melody and accompaniment from the musical composition data, as well as a storage medium storing machine-executable instructions for implementing such musical composition data generation.

In order to accomplish the above-mentioned objects, the present invention provides a musical composition data generation apparatus which comprises: an input section that inputs type information indicative of a type of portable terminal and music composing parameters; and a musical-composition-data generation section that, on the basis of the type information indicative of a type of portable terminal and the music composing parameters inputted via the input section, generates musical composition data suitable for reproduction on a portable terminal of the type indicated by the type information. For example, the musical-composition-data generation section in the present invention carries out an automatic music composition process on the basis of the input type information indicative of a type of portable terminal and music composing parameters and thereby generates musical composition data, taking musical characteristics into account, so that the generated musical composition data suit reproduction on a portable terminal of the type indicated by the type information. For instance, a melody and accompaniment can be performed which is musically natural. As a consequence, the present invention can readily generate musical composition data that can reproduce a musically natural performance for each type of portable terminal.

According to another aspect of the present invention, there is provide a musical composition data generation apparatus which comprises: an input section that inputs type information indicative of a type of portable terminal and music composing parameters; a musical-composition-data generation section that generates musical composition data on the basis of at least the music composing parameters inputted via the input section; and an adjustment section that, on the basis of the type information indicative of a type of portable terminal inputted via the input section, adjusts predetermined musical characteristics of the musical composition data generated by the musical-composition-data generation section. Thus, balance in predetermined musical characteristics between portable terminals of different types can be achieved by adjusting the predetermined musical characteristics of the generated musical composition data in accordance with the individual portable terminal types. For example, where the portable terminals of different types differ from each other in volume characteristics of tones generated from the same musical composition data, tones can be reproduced from the musical composition data with same musical characteristics for any type of portable terminal, through tone volume level adjustment performed on the musical composition data to provide equal generated-tone volume characteristics. The present invention is not necessarily so limited and may also be applied to cases where control is performed on a musical characteristic peculiar to the type of portable terminal.

According to still another aspect of the present invention, there is provided a musical composition data generation apparatus which comprises: an input section that inputs music composing parameters; a musical-composition-data generation section that generates musical composition data on the basis of the music composing parameters inputted via the input section; and a conversion section that receives type information designating a type of portable terminal and converts a data format of the musical composition data, generated by the musical-composition-data generation section, into a predetermined data format suitable for reproduction on a portable terminal of the type of designated by the type information. For example, the musical-composition-data generation section in the present invention first generates musical composition data of a predetermined data format (e.g., MIDI format) irrespective of the type of portable terminal, and then converts the data format of the thus-generated musical composition data into a predetermined data format suiting the type of a portable terminal to be used.

According to still another aspect of the present invention, there is provided a musical composition data generation apparatus which comprises: an input section that inputs type information indicative of a type of portable terminal and music composing parameters; a musical-composition-data generation section that, on the basis of the type information indicative of a type of portable terminal and music composing parameters inputted via the input section, generates musical composition data suitable for reproduction on a portable terminal of the type indicated by the type information; a storage section that stores the musical composition data generated by said musical-composition-data generation section; a reading section that reads out, from said storage section, selected musical composition data; and a transmission section that transmits the read-out musical composition data to a designated portable terminal.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the described embodiments represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIG. 1 is a block diagram illustrating a general organization of an embodiment of a music information transmission/reception system in which is employed a musical composition data generation apparatus of the present invention;

FIG. 2 is a block diagram showing an exemplary hardware setup of one of PC and portable terminals employed in the music information transmission/reception system shown in FIG. 1;

FIG. 11 is a conceptual diagram showing an example of a balance-achieving adjusting table.

DETAILED DESCRIPTION OF THE INVENTION

Figure 3:
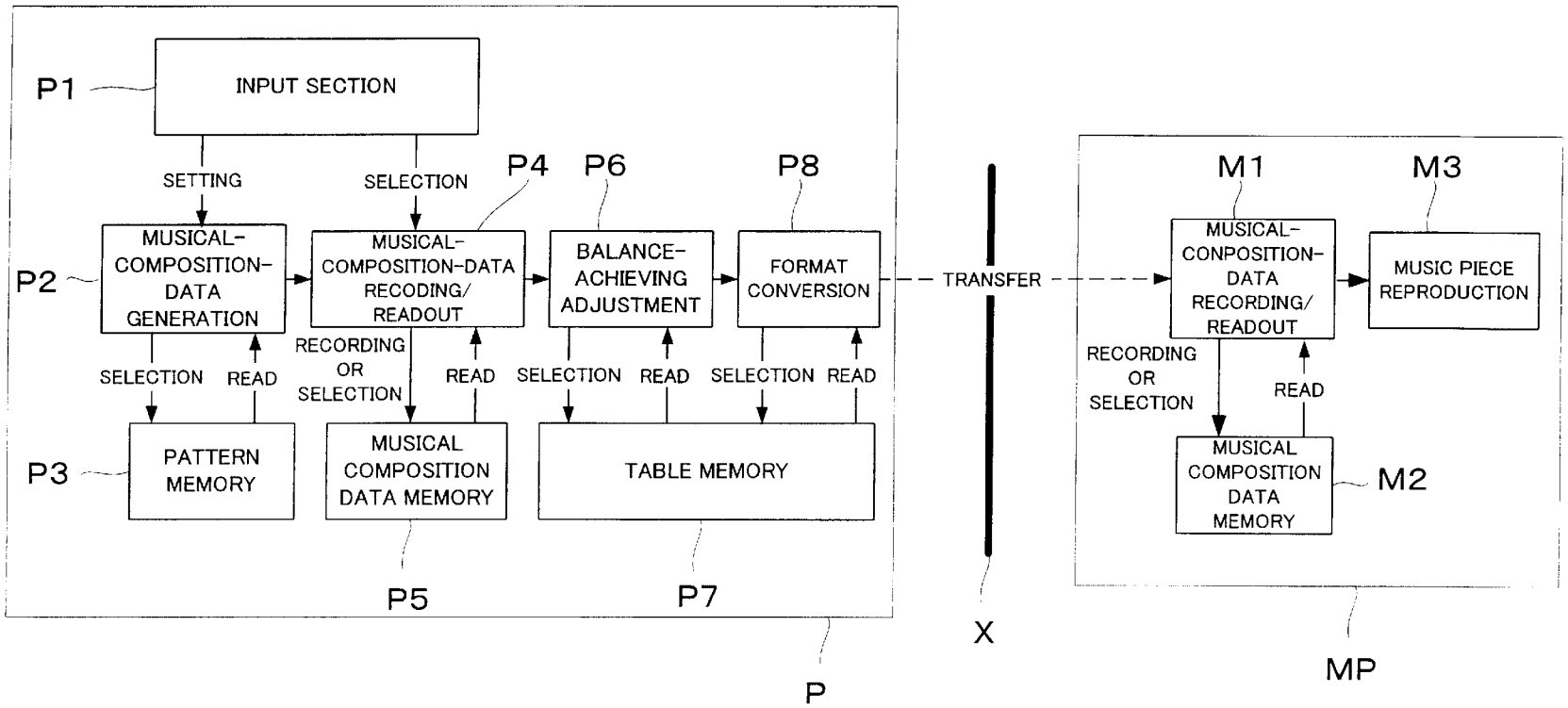
FIG. 3 is a functional block diagram explanatory of musical-composition-data generating, delivering and reproducing functions of the PC and portable terminals in the music information transmission/reception system of FIG. 1.

FIG. 1 is a block diagram illustrating a general organization of an embodiment of a music information transmission/reception system where is employed a musical composition data generation apparatus of the present invention. This music information transmission/reception system includes a PC terminal P constituting the musical composition data generation apparatus of the present invention, portable terminals MP such as cellular phones and/or PDAs (Personal Digital Assistants), and communication networks X connecting these terminals MP and P. Each of the PC terminal P and portable terminals MP constituting the music information transmission/reception system comprises an independent computer that includes a CPU, a ROM, a RAM, a communication interface, etc. as will be later detailed. Thus, each of the terminals P and MP can transmit or receive various information, such as musical composition data of a melody and accompaniment, via the wired or wireless communication network X. Note that although the music information transmission/reception system may include other hardware components than the above-mentioned, the following description will be made in relation to a case where the system includes only minimum necessary resources, for simplicity of description.

In the instant embodiment, the PC terminal P comprises a personal computer, which can function as the musical composition data generation apparatus by installation therein predetermined software programs for generating musical composition data of melodies and accompaniments. On the other hand, each of the portable terminals MP is a small-sized terminal, such as a cellular phone, PDA or the like, capable of wired or wireless communication and has, in addition to the primary communication function, a reproduction function for reproducing musical composition data. Namely, each of the portable terminals MP in the system is capable of reproducing a melody and accompaniment on the basis of musical composition data. The PC terminal P and each of the portable terminals MP are interconnected via the wired or wireless communication network X, such as a LAN (Local Area Network), the Internet or telephone line network, so that the user can transmit/receive various information of a melody and accompaniment to/from the PC terminal P by connecting the PC terminal P to the communication network X and accessing the portable terminal MP. Namely, bidirectional communication can be carried out between the PC terminal P and any one of the portable terminals MP. Each of the portable terminals MP can receive the musical composition data of a melody and accompaniment from the PC terminal P, visually show contents of the received musical composition data on a display device in a predetermined display format (e.g., show the melody and accompaniment on a musical staff on the display device), and also use the melody and accompaniment as an incoming call (message) alerting sound on the basis of the received musical composition data. In other words, the music information transmission/reception system thus arranged permits transmission/reception of the melody and accompaniment between the PC terminal P and any one of the portable terminals MP.

Whereas FIG. 1 shows only one PC terminal P and two portable terminals MP connected to the wired or wireless communication network X for simplicity of illustration, any other number of the PC terminal P and portable terminal MP, e.g. one or more PC terminals P and one or more portable terminals MP, may of course be connected to the wired or wireless communication network X.

As noted earlier, each of the PC terminal P and portable terminals MP constituting the music information transmission/reception system comprises an independent computer including a CPU, ROM, RAM, communication interface, etc. Because the terminals P and MP are constructed similarly, a hardware setup of just one of the PC and portable terminals P and MP will hereinafter be outlined representatively with reference to FIG. 2. Namely, FIG. 2 is a block diagram showing an exemplary hardware setup of one of the PC and portable terminals P and MP.

The PC terminal P (or portable terminal MP) in the music information transmission/reception system is controlled by a microcomputer comprising a microprocessor unit (CPU) 1, a read-only memory (ROM) 2 and a random-access memory (RAM) 3. The CPU 1 controls overall operation of the entire terminal P or MP. To the CPU 1 are connected, via a data and address bus 1D, the ROM 2, RAM 3, operation detection circuit 4, display circuit 5, communication interface 6, tone generator circuit 7 and external storage device 8. Also connected to the CPU 1 is a timer 1A for counting various time periods, for example, to signal interrupt timing for timer interrupt processing. Namely, the timer 1A generates tempo clock pulses for counting a time interval or setting a performance tempo of a melody. The frequency of the tempo clock pulses is adjustable via an operator unit 4A including various switches, operators, etc. Such tempo clock pulses generated by the timer 1A are given to the CPU 1 as processing timing instructions or as interrupt instructions. The CPU 1 carries out various processes in accordance with such instructions from the timer 1A. The various processes carried out by the CPU 1 here include processes relating to automatic performance of a melody and accompaniment on the basis of generated musical composition data.

The ROM 2 has prestored therein various programs to be executed by the CPU 1 and various data to be referred to by the CPU 1. The RAM 3 is used as a working memory for temporarily storing: various information to be used for composing a melody and accompaniment, such as melody patterns, style patterns and chord progression patterns that will be later described; information pertaining to types, e.g. manufactures and/or models, of portable terminals MP, such as balance-achieving adjusting tables and format converting tables that will also be later described; tone performance conditions to be used for automatically performing a composed melody and accompaniment; and various data generated as the CPU 1 executes the programs. The RAM 3 is also used as a memory for storing the currently-executed program and data related thereto. Predetermined address regions of the RAM 3 are allocated to various functions and used as registers, flags, tables, etc.

The operator unit 4A includes various switches and operators for designating various tone generating parameters to be used for automatically generating musical composition data of a melody and accompaniment, inputting various performance conditions to be used for an automatic performance. For example, the operator unit 4A may be in the form of a ten-button keypad for manual entry of numeric value data and a keyboard for manual entry of text data, and/or a switch panel. The operator unit 4A may also include operators for selecting, setting and controlling a tone pitch, color, effect, etc. The operation detection circuit 4 constantly detects respective operational states of the individual operators on the operator unit 4A and outputs switch information, corresponding to the detected operational states of the operators, to the CPU 1 via the data and address bus 1D. The display circuit 5 visually displays various information, such as the contents of the above-mentioned parameters and musical composition data of a melody and accompaniment, on the display device 5A that may comprise an LCD (Liquid Crystal Display) or CRT (Cathode Ray Tube). In addition, the display circuit 5 displays, on the display device 5A, performance conditions, controlling state of the CPU 1, etc. at the time of an automatic performance of a music piece.

Further, the communication interface 6 is connected to the communication network X, such as a LAN (Local Area Network), the Internet or telephone line network, via which it can be connected to other equipment such as a portable terminal MP so that various information, such as musical-composition-data designating information, is transmitted from the portable terminal MP to the PC terminal P or various information, such as musical composition data of a melody and accompaniment, is transmitted from the PC terminal P to the portable terminal MP. For example, in a situation where a user-desired melody is not contained in the ROM 2 or external storage device (hard disk) 8 of the portable terminal MP, the communication interface 6 may be used so that the user can download information of the desired melody and the like from the PC terminal P. Namely, the potable terminal MP sends a command to request the PC terminal P to download information of the desired melody and the like by way of the communication interface 6 and communication network X. In response to the command from the portable terminal MP, the PC terminal P delivers the requested information of the desired melody and the like to the portable terminal MP via the communication network X. The portable terminal MP receives the information of the desired melody and the like from the PC terminal P via the communication interface 6 and accumulatively store them into the external storage device (hard disk) 8 or the like. In this way, the necessary downloading of the information of the desired melody and the like is completed. With such arrangements, the portable terminal MP is allowed to use the received melody as an incoming call alerting sound.

It should be appreciated that the communication interface 6 and communication network X may be of either or both of wired and wireless types.

The tone generator (T.G.) circuit 7, which is capable of simultaneously generating a plurality of tone signals in a plurality of channels, receives information, such as melody-related performance data, supplied via the data and address bus 1D and generates tone signals based on the received information. Each of the tone signals thus generated by the tone generator circuit 7 is audibly reproduced or sounded by a sound system 7A including amplifiers and speakers. The tone generator circuit 7 and sound system 7A may be constructed in any desired conventional manner.

The external storage device 8 is provided for storing tone generating parameters to be used for composing a melody and accompaniment, musical composition data of existing melodies and accompaniments, and other data such as those pertaining to control of various programs to be executed by the CPU 1. Where a particular control program is not prestored in the ROM 2, the control program may be prestored in the external storage device (e.g., hard disk device) 8, so that, by reading the control program from the external storage device 8 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 8 may use any of various removable-type media other than the hard disk (HD), such as a floppy disk (FD), compact disk (CD-ROM or CD-RAM), magneto-optical disk (MO), digital versatile disk (DVD) and semiconductor memory.

Note that the portable terminal MP may dispense with the external storage device 8. Further, each of the above-mentioned devices may be other than a dedicated device as long as it is constructed to create, deliver or reproduce a melody using predetermined software or hardware based on the principles of the present invention.

Now, with reference to FIG. 3, a description will be made about the functions (i.e., functions of generating, delivering and reproducing musical composition data) of the PC and portable terminals P and MP shown in FIG. 1. Namely, FIG. 3 is a functional block diagram explanatory of the musical-composition-data generating, delivering and reproducing functions of the PC and portable terminals P and MP. However, for simplicity of description, the following paragraphs describe the musical-composition-data generation, delivery and reproduction of just one PC terminal P and one portable terminal MP connected to the communication network X.

According to the functions performed by the PC terminal P, the PC terminal P can be broadly divided into an input section P1 for inputting predetermined parameters, a musical-composition-data generation section P2 for generating musical composition data, a musical-composition-data recording/readout section P4 for recording and reading out the generated musical composition data, a balance-achieving adjustment section P6 for modifying musical characteristics, such as tone volume and tone quality, of the musical composition data, and a format conversion section P8 for converting the data format of the musical composition data. More specifically, the input section P1 sets (input) parameters for generating desired musical composition data into the succeeding musical-composition-data generation section P2. For example, the parameters passed from the input section P1 are entered into the terminal by the user manipulating the operator unit 4A or introduced into the terminal from other or external equipment via the communication network 6. In the instant embodiment, the input parameters include at least tone generating parameters characterizing various musical factors, such as musical parameters pertaining to a musical key, musical time, pitch leap dynamics, presence/absence of syncopation and chord progression, of a music piece to be automatically composed, and terminal specifying parameters indicative of the manufacturer and/or model of the portable terminal in question. The musical-composition-data generation section P2 generates musical composition data in accordance with the tone generating parameters input via the input section P1 and using the input tone generating parameters and pattern data read out from a pattern memory P3, as will be later described in detail. In association with possible input parameters, the pattern memory P3 has prestored therein a plurality of kinds of melody patterns, style patterns and chord progression patterns. Here, each of the melody patterns, defining contents of a melody part, comprises, for example, performance data that are representative of a specific example of a melody and include: rhythm generating data, such as data indicative of the number of notes, musical time, presence/absence of syncopation, the number of measures in the music piece in question, and organization of the music piece; and pitch generating data, such as data indicative of an absolute pitch range and extent of pitch variations over a predetermined section of the music piece. Each of the style patterns, defining contents of accompaniment parts, comprises performance data representative of specific example of accompaniments such as a backing and bass. Further, each of the chord progression patterns defines a chord progression of a music piece that is made up, for example, of 32 measures. The musical-composition-data generation section P2 reads out one melody pattern, style pattern and chord progression pattern from among the patterns stored in the pattern memory in accordance with the input parameters passed from the input section P1, and automatically generates musical composition data of the melody and accompaniment parts on the basis of the read-out pattern data. The musical composition data automatically generated here are in an ordinary or common format such as the SMF (Standard MIDI File) format. The automatically-generated musical composition data are transmitted to the musical-composition-data recording/readout section P4. Namely, the musical-composition-data generation section P2 automatically generates or creates musical composition data in accordance with the input parameters from the input section P1 and transmits the thus-generated musical composition data to the musical-composition-data recording/readout section P4.

The musical-composition-data recording/readout section P4 records the musical composition data, automatically generated by the musical-composition-data generation section P2, into a musical composition data memory P5, or reads out desired musical composition data from the musical composition data memory P5 in accordance with selection information from the input section P1. The musical composition data memory P5 is a memory for storing a plurality of sets of musical composition data that include automatically-generated musical composition data and previously-acquired existing musical composition data. Thus, any desired set of automatically-generated musical composition data or previously-acquired existing musical composition data can be retrieved from the musical composition data memory P5 and then used at any desired time, whenever necessary. The balance-achieving adjustment section P6 adjusts musical characteristics, such as tone volume and tone quality, of the musical composition data in accordance with the type, i.e. manufacturer and/or model, of the portable terminal (cellular phone). That is, this balance-achieving adjustment section P6 modifies the tone volume and tone quality (more specifically, various tone volume data and tone color data) of the musical composition data, read out from the musical composition data memory P5 by the musical-composition-data recording/readout section P4, on the basis of a balance-achieving adjusting table (to be later described) provided in a table memory P7 in such a manner that the tone volume and tone quality suits those set by the manufacturer and/or model of the portable terminal in question. On the basis of contents of a format converting table, the format conversion section P8 converts the format of the musical composition data, having been thus adjusted in musical characteristics by the balance-achieving adjustment section P6, into a particular format suiting the type, manufacturer and/or model, of the portable terminal (cellular phone) to which the musical composition data are to be transferred. The format conversion section P8 transfers, to the portable terminal MP, the musical composition data having the format thus converted (or left unconverted when the format conversion is not necessary). This way, even simple operations allow the automatically-generated musical composition data to be used on various portable terminals MP of a plurality of different types, i.e. manufacturers and/or models. Namely, the instant embodiment can simply generate musical composition data of a particular melody and accompaniment suitable for reproduction on portable terminals of any manufacturers and/or models, by converting the format of the musical composition data depending on the manufacturers and/or models of the portable terminals MP to which the musical composition data are to be transferred.

In the instant embodiment, one table memory P7 contains the balance-achieving adjusting tables having recorded therein balance-achieving adjustment amounts corresponding to various manufacturers and/or models of portable terminals MP, and the format converting tables having recorded therein rules (schemes) for conversion into particular formats for the various manufacturers and/or models of portable terminals MP.

Further, according to the functions performed by the portable terminal MP, the portable terminal MP can be divided into a musical-composition-data recording/readout section M1 for recording/reading out the musical composition data received from the PC terminal P, and a music piece reproduction section M3 for reproducing the musical composition data. The musical-composition-data recording/readout section M1 stores the musical composition data, transferred from the PC terminal P, into a musical composition data memory M2, and reads out a desired set of the musical composition data in accordance with a selection made by the user. Namely, the musical-composition-data recording/readout section M1 of the portable terminal MP functions in a similar manner to the musical-composition-data recording/readout section P4 of the above-described PC terminal P. The musical composition data read out from the musical composition data memory M2 are transmitted to the music piece reproduction section M3, which reproduces the melody and accompaniment on the basis of the transmitted musical composition data.

With the above-described arrangements, the musical composition data automatically generated by the PC terminal P can be appropriately utilized or reproduced on the portable terminal MP. Namely, the portable terminal MP is allowed to reproduce the musical composition data to perform a melody and accompaniment as an incoming call alerting sound or BGM (background music) during a telephone conversation.

As having been set forth above in relation to FIG. 3, the musical-composition-data generation section P2 in the PC terminal P automatically generates musical composition data in accordance with various settings of input tone generating parameters. The following paragraphs details a musical-composition-data generation process carried out by the musical-composition-data generation section P2 in the PC terminal P, with reference to FIG. 4 that is a flow chart showing an exemplary operational sequence of the musical-composition-data generation process.

Once the parameters are received from the input section P1, the musical-composition-data generation section P2 sends the received parameters to each of a melody pattern readout section Pa, chord progression pattern readout section Pf and style pattern readout section Pd. Upon receipt of the parameters from the generation section P2, the melody pattern readout section Pa reads out, from the pattern memory P3, one of the melody patterns (each comprising performance data representative of a specific melody) which corresponds to the tone generating parameters contained in the received parameters. The melody pattern to be read out from the pattern memory P3 may be selected using the terminal specifying parameters pertaining to the manufacturer and/or model of the portable terminal MP. The chord progression pattern readout section Pf, upon receipt of the parameters, reads out, from the pattern memory P3, one of the chord progression patterns (each comprising chord sequence data representative of a specific chord progression) which corresponds to the tone generating parameters contained in the received parameters. The chord progression pattern to be read out from the pattern memory P3 may also be selected using the terminal specifying parameters pertaining to the manufacturer and/or model of the portable terminal MP. Further, the style pattern readout section Pd, upon receipt of the parameters, reads out, from the pattern memory P3, one of the style patterns (each comprising performance data representative of specific accompaniments such as a backing and bass) which corresponds to the tone generating parameters contained in the received parameters and terminal specifying parameters pertaining to the manufacturer and/or model of the portable terminal MP.

Figure 5:
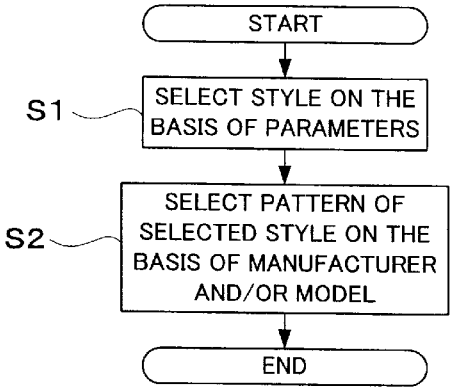
FIG. 5 is a flow chart showing an exemplary operational sequence of a style pattern readout process carried out by a style pattern readout section.
Figure 6:
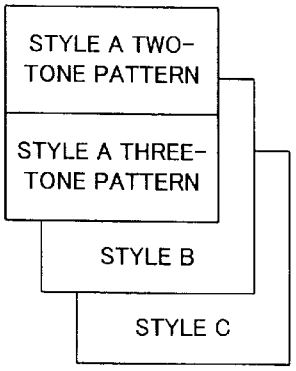
FIG. 6 is a diagram showing an example of data organization of style patterns stored in a pattern memory.

Style pattern readout process carried out by the style pattern readout section Pd and data organization of the style pattern will now be described with reference to FIGS. 5 and 6, respectively. FIG. 5 is a flow chart showing an exemplary operational sequence of the style pattern readout process carried out by the style pattern readout section Pd, and FIG. 6 is a diagram showing an example of data organization of the style pattern.

In FIG. 5, the style pattern readout section Pd selects, at step S1, one of the styles stored in the pattern memory P3, on the basis of the tone generating parameters contained in the received parameters. Then, at step S2, the style pattern readout section Pd selects one of the style patterns belonging to the selected style, on the basis of the terminal specifying parameters contained in the received parameters. As clearly seen from FIG. 6, a plurality of style patterns are prestored for each of a plurality of styles, such as musical genres like "jazz", "classic" and "pop" and feelings or impressions given by music pieces like "urbane", "rustic", "tropical" and "danceable"; each of the styles includes a plurality of style patterns (e.g., style A two-tone pattern, style A three-tone patterns, . . . ) useable on portable terminals MP of various different manufactures and/or models. The "two-tone pattern" data are data on the basis of which performance data of accompaniment parts are to be generated with the number of simultaneously-generatable tones limited to two, and similarly the "three-tone pattern" data are data on the basis of which performance data of accompaniment parts are to be generated with the number of simultaneously-generatable tones limited to three. That is, each of the style patterns comprises performance data for one or more measures generated in accordance with predetermined chord types for one or more parts. In the style pattern readout process of FIG. 5, any one of the prestored styles (style A, style B and style C) is selected in accordance with the musical factors (tone generating parameters) contained in the parameters received from the input section P1 (see step S1), and a selection is made, in accordance with the manufacture or type (terminal specifying parameters) of the portable terminal MP, as to which of the patterns (style A two-tone pattern and style A three-tone pattern) belonging to the selected style should be used (see step S2).

Referring back to FIG. 4, a melody part generation section Pb and accompaniment part generation section Pe generate the melody and accompaniment parts on the basis of the melody pattern, chord progression pattern and style pattern read out by the melody pattern readout section Pa, chord progression pattern readout section Pf and style pattern readout section Pd, respectively.

The accompaniment part generation section Pe generates the accompaniment parts in the following manner. Namely, the style pattern selectively read out by the style pattern readout section Pd is given to the accompaniment part generation section Pe, so that the accompaniment part generation section Pe generates performance data for the accompaniment parts on the basis of the style pattern and the chord progression pattern read out by the chord progression pattern readout section Pf. The performance data for the accompaniment parts may be generated in any one of the conventionally-known methods, among which is one that, for each of the measures (e.g., 32 measures) in the entire music piece, modifies pitch data, contained in the style pattern read out by the style pattern readout section Pd, to match chord progression data in the read-out chord progression pattern on the basis of the read-out chord progression pattern and thereby generates all the accompaniment parts of the music piece in question.

Figure 7:
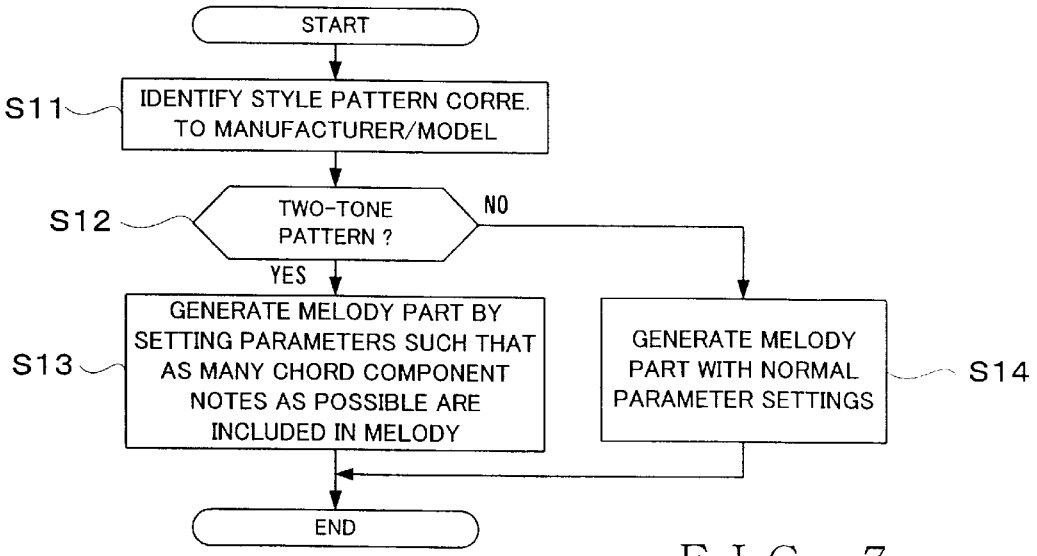
FIG. 7 that is a flow chart showing an exemplary operational sequence of a melody generation process carried out by a melody part generation section.

The melody part generation section Pb generates the melody part in the following manner. Namely, the melody part generation section Pb generates performance data for the melody part on the basis of the melody pattern read out by the melody pattern readout section Pa and the chord progression pattern read out by the chord progression pattern readout section Pf. In thus generating the performance data for the melody part, there is used the parameters pertaining to the manufacture or type of the portable terminal MP (terminal specifying parameters) as well as the tone generating parameters. Example of a melody generation process carried out by the melody part generation section Pb will now be described, with reference to FIG. 7 that is a flow chart showing an exemplary operational sequence of the melody generation process.

At step S11, the style pattern corresponding to the manufacture or type of the portable terminal MP is identified. Then, a determination is made at step S12 as to whether or not the identified style pattern is the two-tone style pattern. If the identified style pattern is the two-tone style pattern (affirmative or YES determination at step S12), the process goes to step S13 in order to generate the melody part by setting parameters such that as many chord component notes are included in the generated melody. If, on the other hand, the identified style pattern is not the two-tone style pattern (negative or NO determination at step S12), the process branches to step S14, where the melody part is generated with normal parameter settings. That is, tone pitches of the melody part are controlled depending on whether the accompaniment parts are to be generated with the three-tone style pattern or with the two-tone style pattern, i.e. in accordance with the type, manufacture and/or model, of the portable terminal MP. When the accompaniment parts are to be generated with the three-tone style pattern, it can be considered that the accompaniment pattern contains three-note chords, and thus the melody part is generated in the normal manner without much consideration given to the chord component notes in determining the tone pitches of the melody part. When, on the other hand, the accompaniment parts are to be generated with the two-tone style pattern, it can be considered that the accompaniment pattern contains only two-note chords, the melody part is generated in such a manner that as many tone pitches as possible of the melody part correspond to the chord component notes so that the melody part can sound beautifully when reproduced. When the melody part is to be generated at step S13 or S14, a motif or one entire music piece is generated by use of the read-out melody pattern (and chord pattern) and the set parameters. The parameters used for the melody part generation may be set using a combination of the information about the portable terminal (e.g., terminal specifying parameters) and the musical information such as the user-input tone generating parameters, etc.

The melody part may be generated in any one of the conventionally-known methods, one example of which will be described below only briefly for reference. First, rhythm data (i.e., data defining respective positions of notes) of a motif, such as an leading portion or bridge portion of a music piece, having several measures are generated on the basis of rhythm generating data contained in the read-out melody pattern, and then rhythm data for the entire music piece are generated on the basis of the motif and musical composition data in the read-out melody pattern. For example, the rhythms for the entire music piece may be generated on the basis of musical period marks in such a manner that a same rhythm is generated for periods imparted with a same period mark and similar rhythms are generated for periods imparted with similar period marks (e.g., a former portion of a given period with a particular period mark may be given a rhythm similar to that of a previous period with a period mark similar to the particular period). Then, important hit points are detected from among individual hit points in the thus-generated rhythm data. The important hit points represent specially musically important hit points of all the melody-constituting hit points; as an example, hit points at downbeats, i.e. first and third beats of each measure, or hit points close to the first and third beats may be detected as the important hit points. Other hit points than such important hit points are detected as unimportant hit points. Of course, the important hit points are not necessarily restricted to the downbeat positions or positions close to the downbeat positions, and other positions satisfying other criteria may be detected as the important hit points. On the basis of pitch generating data and chord progression pattern contained in the melody pattern, skeleton tones of the motif of several measures are first formed and then skeleton tones of the entire music piece are formed with reference to the skeleton tones of the motif, musical composition data, etc. As the skeleton tones of the motif, chord component notes are selected which have pitches falling within the pitch range and pitch variation extent of the pitch generating data. The skeleton tones are allocated to the detected important hit points, while scale pitches of the available notes of corresponding chord notes are allocated to the unimportant hit points. Note that as with the above-described rhythm generation, pitches of the skeleton notes and unimportant notes for the entire music piece may be generated on the basis of musical period marks in such a manner that a same pitch is generated for periods imparted with a same period mark and similar pitches are generated for periods imparted with similar period marks (e.g., a former portion of a given period with a particular period mark may be given a pitch similar to that of a previous period with a period mark similar to the particular period). The thus-generated performance data are automatically modified, in accordance with musical rules, so as to avoid occurrence of musically unnatural sounds. The melody part is generated in the above-described manner.

Note that arrangements may be made to allow the user to modify the automatically-generated pitches of the important hit points and/or unimportant hit points. Further, the user may be allowed to modify the pitches of the motif alone or the entire music piece. Furthermore, whereas the instant embodiment has been described as imparting pitches to the entire music piece after the generation of the rhythm data of the entire music piece, alternative arrangements may be made such that pitches are first imparted to the motif after the generation of the rhythm data of the motif, then rhythm data are generated for the subsequent portions of the music piece and then pitches are imparted to the subsequent portions.

Figure 4:
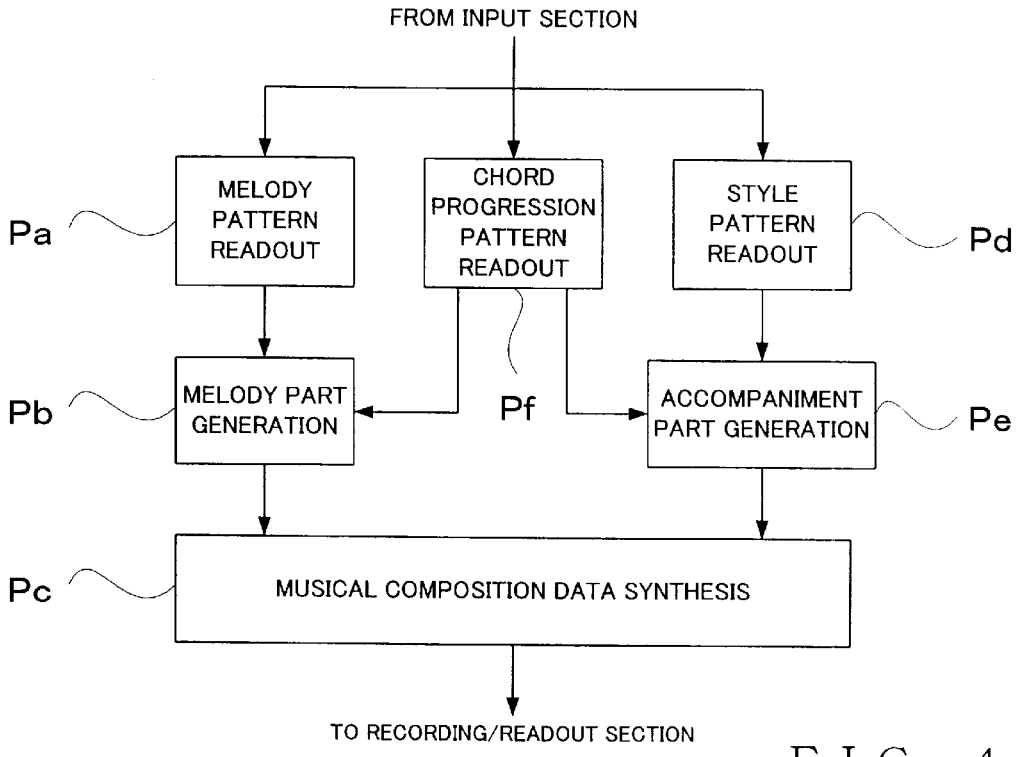
FIG. 4 is a flow chart showing an exemplary operational sequence of a musical-composition-data generation process carried out by a musical-composition-data generation section.
Figure 8:
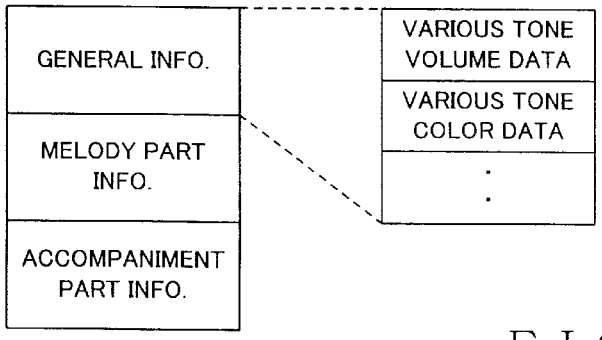
FIG. 8 is a conceptual diagram showing an exemplary organization of musical composition data to be automatically generated.

Referring back FIG. 4, a musical composition data synthesis section Pc generates musical composition data by combining the performance data of the melody part generated by the melody part generation section Pb and the performance data of the accompaniment parts generated by the accompaniment part generation section Pe. The thus-generated musical composition data are transmitted to the musical-composition-data recording/readout section P4. Exemplary organization of the musical composition data to be thus automatically-generated is shown in FIG. 8; FIG. 8 is a conceptual diagram showing an exemplary organization of the musical composition data to be thus automatically-generated.

As shown, each set of the musical composition data comprises general information, melody part information and accompaniment part information. The general information comprises recordings of various settings to be used for reproducing the melody and accompaniment parts, which includes various tone volume data and various tone color data. The various tone volume data are data defining respective reproducing tone volumes of the melody and accompaniment parts, and the various tone color data are data defining various settings of reproducing tone colors of the melody and accompaniment parts. Although not shown or described here, the general information includes various other data, such as data identifying the musical composition data, tempo data, panning data and data format of the musical composition data. Further, the melody part information comprises recordings of the generated performance data of the melody part, and the accompaniment part information comprises recordings of the generated performance data of the accompaniment parts.

Figure 9:
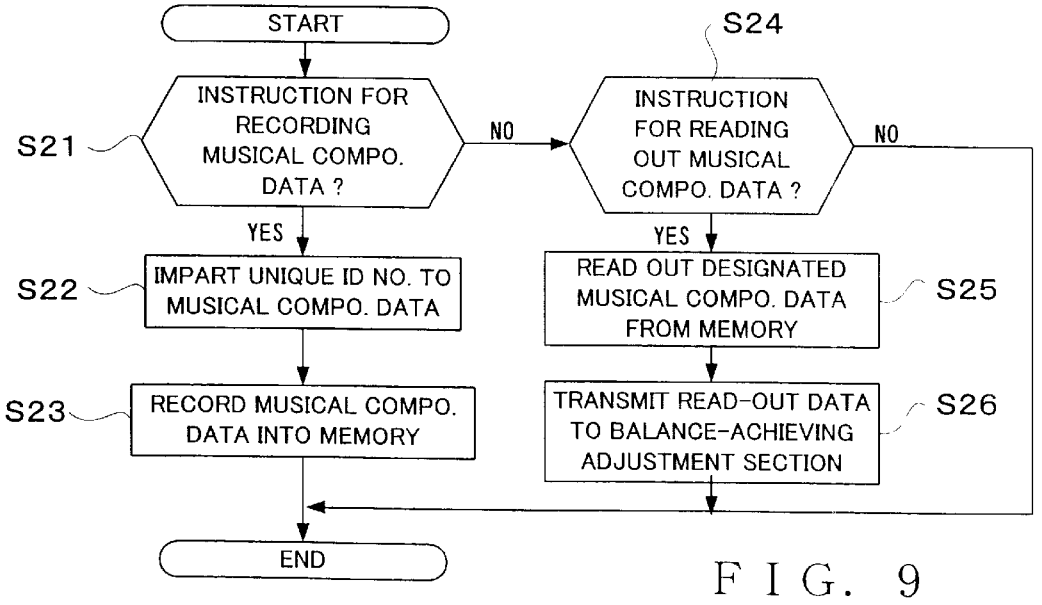
FIG. 9 is a flow chart showing an exemplary operational sequence of a musical-composition-data recording/readout process carried out by a musical-composition-data recording/readout section.

As having been set forth above, the musical-composition-data recording/readout section P4 in the PC terminal P records the musical composition data, automatically generated by the musical-composition-data generation section P2, into the musical composition data memory P5, or reads out desired musical composition data from the musical composition data memory P5 in accordance with the selection information from the input section P1 (see FIG. 3). So, the following paragraphs describe an example of a musical-composition-data recording/readout process carried out by the recording/readout section P4, with reference to FIG. 9 that is a flow chart showing an exemplary operational sequence of the musical-composition-data recording/readout process.

At step S21, a determination is made as to whether there has been given an instruction for recording the musical composition data. If answered in the affirmative at step S21, unique identification information is imparted to the musical composition data at step S22, and the musical composition data with the unique identification are recorded into the musical composition data memory P5 at step S23. If, on the other hand, there has been given no instruction for recording the musical composition data (negative or NO determination at step S21), it is further determined whether or not there has been given an instruction for reading out the musical composition data from the musical composition data memory P5. If there has been given no instruction for reading out the musical composition data (negative determination at step S24), the musical-composition-data recording/readout process is brought to an end. If, on the other hand, there has been given such an instruction for reading out the musical composition data as determined at step S24, the designated musical composition data are read out from the musical composition data memory P5 at step S25, and the thus read-out musical composition data are transmitted to the balance-achieving adjustment section P6 at step S26.

In this manner, the musical-composition-data recording/readout section P4 can record the musical composition data, automatically generated by the musical-composition-data generation section P2, into the musical composition data memory P5, or read out desired musical composition data from the musical composition data memory P5, to transmit the musical composition data to the balance-achieving adjustment section P6.

Figure 10:
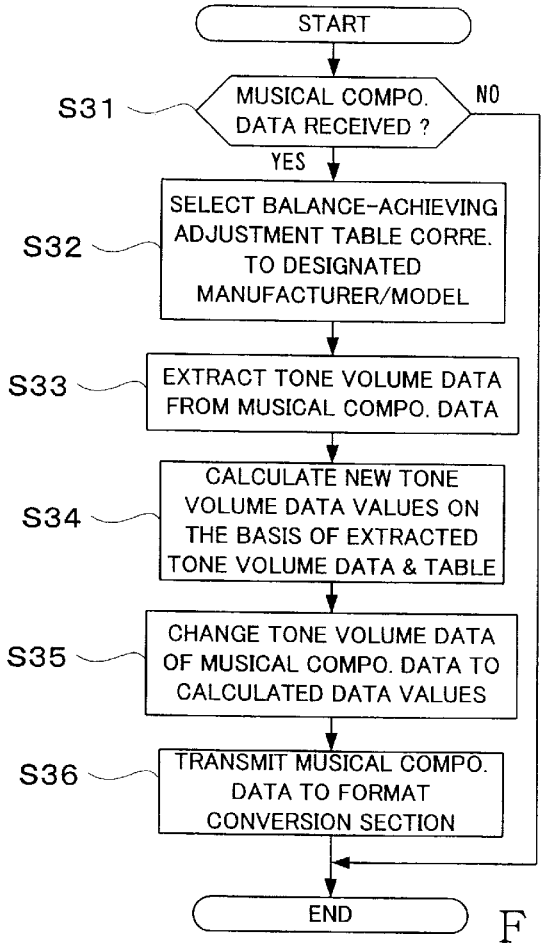
FIG. 10 is a flow chart showing an exemplary operational sequence of a balance-achieving adjustment process carried out by a balance-achieving adjustment section.

As also having been set forth above, the balance-achieving adjustment section P6 adjusts the musical characteristics, such as tone volume and tone quality, of the musical composition data in accordance with the type, manufacturer and/or model, of the portable terminal (cellular phone) (see FIG. 3). The following paragraphs describe a specific example of a balance-achieving adjustment process carried out by the balance-achieving adjustment section P6 in the PC terminal P, with reference to FIG. 10 that is a flow chart showing an exemplary operational sequence of the balance-achieving adjustment process. In the balance-achieving adjustment process, the musical characteristics of the musical composition data are adjusted in accordance with the manufacturer and/or model of the portable terminal; however, for convenience of description, the balance-achieving adjustment process is described here as adjusting only a tone volume characteristic (to achieve a volume balance).

At step S31, a determination is made as to whether there have been received musical composition data. With a negative determination at step S31, the balance-achieving adjustment process is brought to an end. If, however, there have been received musical composition data as determined at step S31, a particular balance-achieving adjusting table (to be detailed later) corresponding to the designated manufacturer and/or model of the portable terminal is selectively read out from the table memory at step S32. The manufacturer and/or model of the portable terminal is identified from the parameters received from the input section P1, as in the case of the musical-composition-data generation process carried out by the musical-composition-data generation section P2. Then, tone volume data are extracted out of the received musical composition data at step S33, and new tone volume data values are determined on the basis of the extracted tone volume data values and contents of the balance-achieving adjusting table at step S34. Thus, the tone volume data values in the received musical composition data are changed to the determined new tone volume data values at step S35. That is, the values of the various tone volume data contained in the general information of the musical composition data are changed to tone volume data values determined using the identified manufacturer and/or model of the portable terminal and the balance-achieving adjusting table of the table memory P7. Then, at step S36, the musical composition data are transmitted to the format conversion section P8.

In the above-described manner, the balance-achieving adjustment section P6 can adjust the musical characteristics of the musical composition data so as to suit the manufacturer and/or model of the portable terminal MP in question.

Now, a description will be made about the balance-achieving adjusting table that is used for adjusting the musical characteristics of the musical composition data so as to suit the manufacturer and/or model of the portable terminal MP. FIG. 11 is a diagram showing an exemplary organization of the balance-achieving adjusting table. In the balance-achieving adjusting table, there is stored, for each manufacture and/or model of portable terminal MP, a ratio of modification with respect to various original tone volume data (tone volume values) in the musical composition data. The balance is achieved here by multiplying the original tone volume values by the ratio of modification. In the illustrated example, the balance-achieving adjusting table has stored therein a ratio of modification "1.5" for model "a" of manufacturer "A", a ratio of modification "0.5" for model "b" of manufacturer "A", and a ratio of modification "1.0" (i.e., no modification to the original tone volumes) for model "a" of manufacturer "B". The balance-achieving adjustment section P6 modifies the musical characteristics (in this case, tone volume data values) of the musical composition data in accordance with the ratio of modification stored in the balance-achieving adjusting table.

Other examples of the musical characteristics adjustable in the instant embodiment include the tone color, panning and tempo of the musical composition data. The tone color corresponds to various tone color data included in the musical composition data. As with the tone volume adjustment, the tone color adjustment is made by modifying various tone color data of the musical composition data in accordance with contents of the prestored balance-achieving adjusting table corresponding to the manufacturer and/or model of the portable terminal. Specific examples of the various tone color data include a tone color number determining a particular tone color, filter for controlling a tone color waveform and parameters for setting an envelope. Values for adjusting the tone color data are previously stored in the balance-achieving adjusting table.

Figure 12:
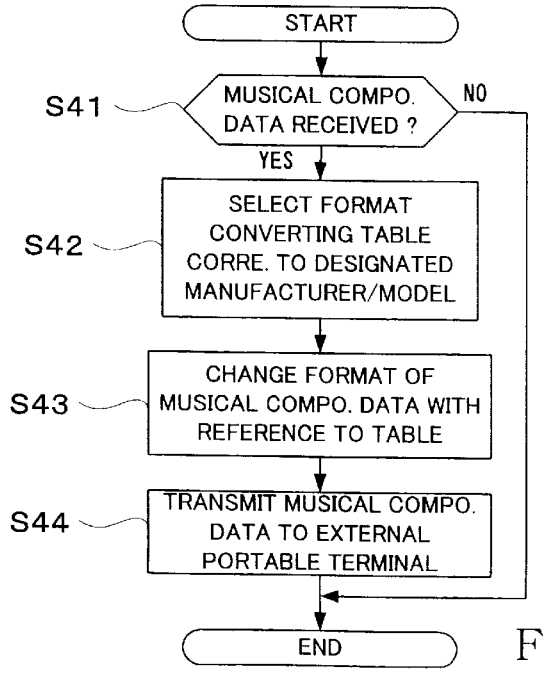
FIG. 12 is a flow chart showing an exemplary operational sequence of a format conversion process carried out by a format conversion section.

As having been set forth above, the format conversion section P8 converts the format of the musical composition data into the particular format suiting the manufacturer and/or model of the portable terminal MP in question and transfers the format-converted musical composition data to the portable terminal MP (see FIG. 3). FIG. 12 is a flow chart showing an exemplary operational sequence of a format conversion process carried out by the format conversion section P8. In the format conversion process, the format of the musical composition data is converted so as to suit the manufacturer and/or model of the portable terminal MP in question.

At step S41, a determination is made as to whether or not the format conversion section P8 has received the musical composition data. With a negative determination at step S41, the format conversion process is brought to an end. If, on the other hand, the format conversion section P8 has received the musical composition data as determined at step S41, the format converting table (not shown) corresponding to the designated manufacturer and/or model of the portable terminal MP in the table memory P7 is looked up at step S42. Then, the format of the musical composition data is converted on the basis of contents of the format converting table, at step S43. In the format converting table, there are stored, for each manufacturer and/or model of portable terminal, conversion data for converting the ordinary or common format into a particular format suiting the manufacturer and/or model of portable terminal. The "particular format" is a format of musical composition data suitable for reproduction of the musical composition data on the portable terminal MP in question. More specifically, the conversion data for converting the ordinary format into the particular format include data indicative of the data format in the portable terminal MP corresponding to the original musical composition data, limitations on the number of simultaneously-generatable tone pitches (e.g., how to reduce or change the data), limitations on the range of the generatable tone pitches (e.g., how to reduce or change the data), how to deal with unuseable data (e.g., whether the data should be reduced or to what kind of data the data should be converted), etc. At following step S44, the format-converted musical composition data are transmitted to the portable terminal MP. Namely, the portable terminal MP receives the musical composition data in the format optimal to the portable terminal MP. Thus, the format-converted musical composition data can be used on various portable terminals MP of a plurality of different manufacturers and/or models to perform a same melody and accompaniment.

In the above-described manner, the format conversion section P8 can convert the format of the musical composition data into the particular format of the manufacturer and/or model of the portable terminal MP in question and transfers the format-converted musical composition data to the portable terminal MP.

Whereas, according to the embodiment of the present invention, the user enters the type, such as the manufacturer and/or model, of the portable terminal MP, information indicative of the type of the portable terminal MP may be supplied directly from the portable terminal MP to the PC terminal P to which the portable terminal MP is connected via the communication network X. The information indicative of the type of the portable terminal MP includes the above-mentioned terminal specifying parameters indicative of the manufacturer and/or model of the portable terminal MP, as well as information indicative of the manufacturer and/or model of the tone generator provided in the portable terminal MP. Therefore, the above-described various processes may be carried out using the information indicative of the manufacturer and/or model of the tone generator rather than the manufacturer and/or model of the portable terminal MP.

Further, whereas the embodiment of the present invention has been described above as storing, in the musical composition data memory P5, musical composition data before being subjected to the balance-achieving adjustment process and format conversion, musical composition data after having undergone the balance-achieving adjustment process and format conversion may be stored in the musical composition data memory P5. In such a case, it is only necessary that the balance-achieving adjustment section P6 and format conversion section P8 of FIG. 3 be provided before the musical-composition-data recording/readout section P4 in the PC terminal P.

Note that arrangements may be made not only for storing the automatically-generated musical composition data in the musical composition data memory P5 of the PC terminal P, but also storing the automatically-generated musical composition data in the musical composition data memory M2 of the potable terminal MP after the user modifies the musical composition data as necessary.

Furthermore, each of the above-described musical-composition-data generation process, style pattern readout process, melody generation process, musical-composition-data recording/readout process, balance-achieving adjustment process and format conversion process may be carried out by a DSP (Digital Signal Processor) device arranged to operate on the basis of microprograms performing processes similar to those in the above-described embodiment, rather than by the software programs. In an alternative, dedicated hardware circuitry may be constructed such that the processes similar to those in the above-described embodiment are carried out by LSI and discrete circuits. The PC terminal P may be either a user computer or a server computer.

It should also be appreciated that the performance data for the melody and accompaniment parts (or the musical composition data to be constructed by combining the performance data for the melody and accompaniment parts) may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Furthermore, where the performance data sets for a plurality of channels are handled in the present invention, the performance data sets for the plurality of channels may be stored together in a mixture or the performance data sets for the channels may be separated from each other on a track-by-track basis.

In summary, the present invention is characterized by automatically generating musical composition data suitable for use on portable terminals, such as cellular phones, of various manufacturers and/or models. Thus, the present invention achieves the superior benefit that a melody and accompaniment represented by the automatically-generated musical composition data can be appropriately reproduced on portable terminals, such as cellular phones, of various manufacturers and/or models without inconveniences. Further, because the automatically-generated musical composition data are converted into a format suiting the manufacturer and/or model of any desired portable terminals (cellular phones), the present invention allows the same melody and accompaniment represented by the automatically-generated musical composition data to be simply reproduced on various portable terminals (cellular phones) of a plurality of different manufacturers and/or models.

What is claimed is:

1. A musical composition data generation apparatus comprising:

an input section that inputs type information indicative of a type of portable terminal and music composing parameters; and a musical-composition-data generation section that, on the basis of said type information indicative of a type of portable terminal and the music composing parameters inputted via said input section, generates musical composition data suitable for reproduction on a portable terminal of the type indicated by said type information.

2. A musical composition data generation apparatus as claimed in claim 1 which further comprises a storage section storing a plurality of pattern data sets, and wherein said musical-composition-data generation section selects, on the basis of at least said type information indicative of a type of portable terminal inputted via said input section, one of the pattern data sets stored in said storage section that is suitable for the type of portable terminal indicated by said type information, and generates musical composition data on the basis of the selected pattern data set and the music composing parameters inputted via said input section.

3. A musical composition data generation apparatus as claimed in claim 2 wherein said musical-composition-data generation section generates, as the musical composition data, accompaniment data on the basis of the selected pattern data set and the music composing parameters inputted via said input section.

4. A musical composition data generation apparatus as claimed in claim 2 wherein said storage section stores, for each accompaniment style, a plurality of kinds of pattern data sets differing in number of simultaneously-generatable tones, an accompaniment pattern having a peculiar number of simultaneously-generatable tones being useable for each type of portable terminal, and wherein said musical-composition-data generation section selects, from among some of the pattern data sets stored in said storage section which correspond to a given accompaniment style designated by the music composing parameters inputted via said input section, one pattern data set that has the number of simultaneously-generatable tones corresponding to a particular type of portable terminal indicated by said type information inputted via said input section, and said musical-composition-data generation section generates accompaniment data on the basis of the selected pattern data set and the music composing parameters.

5. A musical composition data generation apparatus as claimed in claim 1 wherein said musical-composition-data generation section sets control parameters for determining tone pitches of musical composition data to be generated, on the basis of at least said type information indicative of a type of portable terminal inputted via said input section, and wherein said musical-composition-data generation section generates musical composition data having the tone pitches determined by the set control parameters and the music composing parameters.

6. A musical composition data generation apparatus as claimed in claim 5 wherein said musical-composition-data generation section generates, as the musical composition data, melody data on the basis of the control parameters and the music composing parameters.

7. A musical composition data generation apparatus as claimed in claim 5 wherein said musical-composition-data generation section generates, as the musical composition data, melody data and accompaniment data, the accompaniment data having a peculiar number of simultaneously-generatable tones corresponding to the type of portable terminal, and wherein the control parameters set by said musical-composition-data generation section are parameters for determining tone pitches of the melody data and the melody data are automatically generated taking, into account, the number of simultaneously-generatable tones in the accompaniment data.

8. A musical composition data generation apparatus comprising:

an input section that inputs type information indicative of a type of portable terminal and music composing parameters;

a musical-composition-data generation section that generates musical composition data on the basis of at least the music composing parameters inputted via said input section; and an adjustment section that, on the basis of said type information indicative of a type of portable terminal inputted via said input section, adjusts predetermined musical characteristics of the musical composition data generated by said musical-composition-data generation section.

9. A musical composition data generation apparatus as claimed in claim 8 where said adjustment section includes, in association with a plurality of types of portable terminal, tables of adjustment data for adjusting the predetermined musical characteristics, and wherein said adjustment section selects a predetermined one of the tables in accordance with said type information indicative of a type of portable terminal inputted via said input section, reads out the adjustment data from the selected table and adjusts the predetermined musical characteristics of the generated musical composition data on the basis of the read-out adjustment data.

10. A musical composition data generation apparatus as claimed in claim 8 where on the basis of said type information indicative of a type of portable terminal and the music composing parameters inputted via said input section, said musical-composition-data generation section generates musical composition data suitable for reproduction on a portable terminal of the type indicated by said type information.

11. A musical composition data generation apparatus comprising:

an input section that inputs music composing parameters;

a musical-composition-data generation section that generates musical composition data on the basis of the music composing parameters inputted via said input section; and a conversion section that receives type information designating a type of portable terminal and converts a data format of the musical composition data, generated by said musical-composition-data generation section, into a predetermined data format suitable for reproduction on a portable terminal of the type of designated by said type information.

12. A musical composition data generation apparatus as claimed in claim 11 wherein said conversion section includes predetermined data adjusting tables in association with a plurality of types of portable terminal, and wherein said conversion section selects a predetermined one of the data adjusting tables in accordance with the type of portable terminal designated by said type information and converts the data format of the generated musical composition data using the selected data adjusting table.

13. A musical composition data generation apparatus as claimed in claim 11 wherein said input section also inputs type information indicative of a type of portable terminal, and wherein on the basis of said type information indicative of a type of portable terminal and the music composing parameters inputted via said input section, said musical-composition-data generation section generates musical composition data suitable for reproduction on a portable terminal of the type indicated by said type information.

14. A musical composition data generation apparatus comprising:

an input section that inputs type information indicative of a type of portable terminal and music composing parameters;

a musical-composition-data generation section that, on the basis of said type information indicative of a type of portable terminal and music composing parameters inputted via said input section, generates musical composition data suitable for reproduction on a portable terminal of the type indicated by said type information;

a storage section that stores the musical composition data generated by said musical-composition-data generation section;

a reading section that reads out, from said storage section, selected musical composition data; and a transmission section that transmits the read-out musical composition data to a designated portable terminal.

15. A musical composition data generation method comprising:

a step of inputting type information indicative of a type of portable terminal and music composing parameters; and a step of generating, on the basis of said type information indicative of a type of portable terminal and the music composing parameters inputted via said step of inputting, musical composition data suitable for reproduction on a portable terminal of the type indicated by said type information.

16. A musical composition data generation method comprising:

a step of inputting type information indicative of a type of portable terminal and music composing parameters;

a step of generating musical composition data on the basis of at least the music composing parameters inputted via said step of inputting; and a step of adjusting predetermined musical characteristics of the musical composition data generated by said step of generating musical composition data, on the basis of said type information indicative of a type of portable terminal inputted via said step of inputting.

17. A musical composition data generation method comprising:

a step of inputting music composing parameters;

a step of generating musical composition data on the basis of the music composing parameters inputted via said step of inputting; and a step of receiving type information designating a type of portable terminal and converting a data format of the musical composition data, generated by said step of generating musical composition data, into a predetermined data format suitable for reproduction on a portable terminal of the type of designated by said type information.

18. A musical composition data generation method comprising:

a step of inputting type information indicative of a type of portable terminal and music composing parameters;

a step of generating, on the basis of said type information indicative of a type of portable terminal and the music composing parameters inputted via said step of inputting, musical composition data suitable for reproduction on a portable terminal of the type indicated by said type information;

a step of storing the musical composition data generated by said step of generating in a storage section;

a step of reading out, from said storage section, selected musical composition data; and a step of transmitting the read-out musical composition data to a designated portable terminal.

19. A machine-readable storage medium containing a group of instructions to cause said machine to perform a musical composition data generation method, said musical composition data generation method comprising:

a step of inputting type information indicative of a type of portable terminal and music composing parameters; and a step of generating, on the basis of said type information indicative of a type of portable terminal and the music composing parameters inputted via said step of inputting, musical composition data suitable for reproduction on a portable terminal of the type indicated by said type information.

20. A machine-readable storage medium containing a group of instructions to cause said machine to perform a musical composition data generation method, said musical composition data generation method comprising:

a step of inputting type information indicative of a type of portable terminal and music composing parameters;

a step of generating musical composition data on the basis of at least the music composing parameters inputted via said step of inputting; and a step of adjusting predetermined musical characteristics of the musical composition data generated by said step of generating musical composition data, on the basis of said type information indicative of a type of portable terminal inputted via said step of inputting.

21. A machine-readable storage medium containing a group of instructions to cause said machine to perform a musical composition data generation method, said musical composition data generation method comprising:

a step of inputting music composing parameters;

a step of generating musical composition data on the basis of the music composing parameters inputted via said step of inputting; and a step of receiving type information designating a type of portable terminal and converting a data format of the musical composition data, generated by said step of generating musical composition data, into a predetermined data format suitable for reproduction on a portable terminal of the type of designated by said type information.

22. A machine-readable storage medium containing a group of instructions to cause said machine to perform a musical composition data generation method, said musical composition data generation method comprising:

a step of inputting type information indicative of a type of portable terminal and music composing parameters;

a step of generating, on the basis of said type information indicative of a type of portable terminal and the music composing parameters inputted via said step of inputting, musical composition data suitable for reproduction on a portable terminal of the type indicated by said type information;

a step of storing the musical composition data generated by said step of generating in a storage section;

a step of reading out, from said storage section, selected musical composition data; and a step of transmitting the read-out musical composition data to a designated portable terminal.

* * * * *